US006966128B2

(12) United States Patent
McClaskie

(10) Patent No.: US 6,966,128 B2
(45) Date of Patent: Nov. 22, 2005

(54) METHOD AND APPARATUS FOR IMPROVED SHOE CONSTRUCTION

(75) Inventor: Thomas E. McClaskie, Bethlehem, PA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 10/626,139

(22) Filed: Jul. 24, 2003

(65) Prior Publication Data

US 2005/0016022 A1 Jan. 27, 2005

(51) Int. Cl.[7] ..... A43B 13/28; A43D 11/00

(52) U.S. Cl. ..... 36/12; 36/16; 36/18; 36/21; 12/142 C; 12/142 T

(58) Field of Search ..... 36/12, 16, 8, 19 R, 36/21, 22 R, 18; 12/142 C, 142 T

(56) References Cited

U.S. PATENT DOCUMENTS

| | | | | |
|---|---|---|---|---|
| 2,054,188 A | * | 9/1936 | Bates | 36/12 |
| 2,563,092 A | * | 8/1951 | Zacks | 36/9 R |
| 3,412,487 A | | 11/1968 | Diamant | 36/44 |
| 3,416,245 A | | 12/1968 | Ferreira | 36/44 |
| 3,583,080 A | * | 6/1971 | Wagner | 36/16 |
| 3,705,463 A | | 12/1972 | Lown | 36/25 |
| 3,821,827 A | | 7/1974 | Nadler | 36/16 |
| 4,182,055 A | * | 1/1980 | Turner, Jr. | 36/30 R |
| 4,308,671 A | * | 1/1982 | Bretschneider | 36/11 |
| 4,469,589 A | | 9/1984 | Yoo et al. | 36/77 |
| 4,501,076 A | | 2/1985 | Dodds | 36/11 |
| 4,551,929 A | * | 11/1985 | Paris | 36/11 |
| 4,685,223 A | * | 8/1987 | Long | 36/16 |
| 4,908,964 A | | 3/1990 | Deem | 36/88 |
| 4,942,679 A | | 7/1990 | Brandon et al. | 36/102 |
| 5,146,697 A | * | 9/1992 | Weiss | 36/12 |
| 5,311,677 A | | 5/1994 | Mann et al. | 36/107 |
| 5,784,736 A | | 7/1998 | Issler et al. | 12/142 |
| 6,029,301 A | | 2/2000 | Issler et al. | 12/142 |
| 6,192,605 B1 | * | 2/2001 | Challant | 36/17 R |
| 6,457,263 B1 | | 10/2002 | Rudy | 36/29 |
| 2004/0093762 A1 | * | 5/2004 | Issler | 36/19 R |

* cited by examiner

*Primary Examiner*—M. D. Patterson
(74) *Attorney, Agent, or Firm*—St. Onge Steward Johnston & Reens LLC

(57) ABSTRACT

The invention relates to a method and apparatus for providing a shoe having an outsole with a bottom surface for contacting the ground, and where the bottom surface has a notch adapted to receive a stitch and hinder premature wear of the stitch. A socklining is also provided on top of and in direct contact with the outsole for directly contacting a user's foot. Moreover, a cushion is placed between the outsole and socklining and a securing mechanism extends from the socklining to the notch, without extending through the bottom surface, for securing the socklining directly to the outsole.

8 Claims, 5 Drawing Sheets

METHOD AND APPARATUS FOR IMPROVED SHOE CONSTRUCTION

FIELD OF THE INVENTION

The invention relates to a shoe having improved construction.

BACKGROUND OF THE INVENTION

A variety of different shoe constructions are used by the footwear industry. For the most part, each shoe construction has characteristics that make it particularly well-suited for specific applications. For example, some shoe constructions are selected for their durability, others for their flexibility and comfort, while still others are selected for their aesthetic appeal.

In general, shoe construction typically involves a number of manufacturing operations or steps. Normally, a significant number of manufacturing operations generally results in a more expensive shoe. In a market where competitive price is often desired, there appears to be a need to make shoes in an efficient manner. Conventionally, a shoe construction may involve an upper being stitched to a forepart of an outsole by a hand stitch and the rearpart of the outsole may be attached to the upper by adhesive after a lasting operation. Lasting is typically where a last, an object which simulates a user's foot, is inserted into the upper and the upper is often then pulled taught around the last and secured to a tuck, which is removably attached to the bottom of the last. The tuck generally provides a structure that is adhered to the rearpart of the outsole, which in turn results in the upper being secured to the outsole in the rearpart of the shoe. Without a tuck, it may be difficult to secure the upper to the outsole.

A traditional insole is often wrapped with a wrapper around its peripheral edge to help prevent the edge of the insole from wear. The insole with the wrapper is then typically secured to the tuck or outsole. In a separate operation, a socklining may then be adhered directly to the top of the insole for providing a surface adapted to receive a user's foot because the insole's surface is often coarse.

Another shoe construction, cementing, also often involves a number of manufacturing operations. Cementing components of a shoe, such as the upper to the outsole, typically involves a surface preparation step where the surfaces to be cemented, or glued, are clean of debris and readied, which may also include roughening. Further, there may be an application step where the cement is applied to the surfaces. This step may also involve measuring and evenly distributing the glue over the surface.

Further, there may be a pressing step where the surfaces are pressed together. Pressing is believed to reduce air that may be trapped between the surfaces and enhances adhesion. Pressing may also include aligning the surfaces so that the peripheries of the components are flush with one another.

Additionally, once the components are pressed together, cementing often requires a waiting period for the cement to cure, or dry. Generally, not only does cementing involve some or all of the above mentioned manufacturing operations, it also involves time, particularly the curing time.

It is believed that the number of steps and time involved, especially if user intervention is required, negatively affects cost and efficiency. The cementing process may be further complicated if the surfaces to be glued are uneven or difficult to reach.

U.S. Pat. No. 4,369,589 to Summey ("Summey") and U.S. Pat. No. 3,821,827 to Nadler ("Nadler") appear to disclose a shoe having cement or glue to secure the upper to the midsole or outsole. Summey seems to disclose the pressing and aligning operations as well as user intervention described above. Summey also seems to disclose an insole as a part of the shoe.

U.S. Pat. No. 4,685,223 to Long ("Long") seems to relate to a shoe having an upper, socklining margin, and outsole sewn together. A cushion is enclosed by the socklining and the socklining upper is secured to the upper and outsole by the stitch. Hence, the upper is not sewn directly to the outsole. Moreover, although Long discloses a recess in the outsole, it appears to be on a side of the outsole, which may increase stress on the stitch since the stitch seems to be placed in a generally tortuous orientation where the stitch extends vertically downward from the upper and turns generally horizontal out the side of the outsole. Increasing stress on the stitch may contribute toward the stitch's failure.

U.S. Pat. No. 6,029,301 by Issler ("Issler") appears to disclose a shoe having a channel in the bottom surface of the outsole and an upper in contact with a top surface of the outsole, where a stitch passes from the upper to the channel without passing to the bottom surface of the outsole. The channel seems to protect the stitch from wear due to contact between the bottom surface and the ground. However, because the channel appears to be placed within a confined space, dirt, sand, or other debris may get trapped in the space and, as a result, cause wear to the stitch. Moreover, the socklining seems to be adhered to the outsole or cushion, where adhering or gluing the socklining often increases the number of operations and/or cost for constructing the shoe. Furthermore, should the gluing operation prove to be messy, clean up operations may be needed to clean the excess glue.

The sockliner of Issler may be modified to be merely placed on top of the outsole or cushion without adherence. However, in these situations, the sockliner is often attached to a structure, such as a tuck or insole, and the entire unit is then placed on top of the outsole or cushion. Without a tuck or insole, the sockliner may not remain on top of the outsole or cushion as it may tend to slide around due to its lack of structural integrity.

What is desired, therefore, is a shoe that may be constructed in a more efficient manner, including reduced manufacturing costs and less manufacturing operations. What is also desired is a shoe that is efficiently manufactured without sacrificing comfort or aesthetic appeal.

SUMMARY OF THE INVENTION

Accordingly, it is an object of the invention to provide a shoe with improved construction.

Another object of the invention is to reduce manufacturing costs without sacrificing the shoe quality.

A further object of the invention is to provide a shoe having a notch that hinders premature wear on the stitches that secure the shoe together.

These and other objects of the invention are achieved by a shoe having an outsole with a bottom surface for contacting the ground, and where the bottom surface has a notch adapted to receive a stitch and hinder premature wear of the stitch. A socklining is also provided on top of and in direct contact with the outsole for directly contacting a user's foot. Moreover, a cushion is placed between the outsole and socklining and a securing mechanism is extends from the socklining to the notch, without extending through the bottom surface, for securing the socklining directly to the outsole.

In some embodiments, the shoe may include an upper in direct contact with the socklining and the securing mechanism extends from the upper, through the socklining, and to the notch, without extending through the bottom surface, for securing the upper, socklining, and outsole together.

In alternative embodiments, the notch is a relief extending upwardly into the outsole and around at least a portion of a periphery of the outsole.

In other embodiments, the notch includes an outermost periphery of the outsole, an inner periphery smaller than the outermost periphery, a top surface of the notch extending generally perpendicular to and connecting the inner and outermost peripheries together, and a vertical wall extending in a generally downward direction proximate to the inner periphery and connecting the top surface of the notch to the bottom surface of the outsole, wherein the top surface of the notch is between the bottom surface of the outsole and a top surface of the outsole.

In another aspect of the invention, a method for providing a shoe includes the step of providing an outsole having a bottom surface for contacting the ground and notching the bottom surface to provide clearance for a securing mechanism and to hinder the securing mechanism from premature wear due to the bottom surface contacting the ground. The method also includes contacting a socklining to a top surface of the outsole, placing a cushion between the outsole and the socklining, and extending the securing mechanism from the socklining to the notch, without extending through the bottom surface, for securing the socklining directly to the outsole.

Optionally, the method may include the step of providing an upper in direct contact with the socklining, where the securing mechanism extends from the upper, through the socklining, and to the notch, without extending through the bottom surface, for securing the upper, socklining, and outsole together.

In alternative embodiments, the method further includes notching the bottom surface upwardly into the outsole and around at least one portion of a periphery of the outsole.

In some embodiments, the method may also include the steps of providing an outermost periphery and an inner periphery smaller than the outermost periphery, extending a top surface of the notch generally perpendicular to and connecting the inner and outermost peripheries together, and extending a vertical wall in a generally downward direction proximate to the inner periphery and connecting the top surface of the notch to the bottom surface of the outsole, wherein the top surface of the notch is between the bottom surface of the outsole and a top surface of the outsole.

The invention and its particular features and advantages will become more apparent from the following detailed description considered with reference to the accompanying drawings.

DETAILED DESCRIPTION OF THE DRAWINGS

Figure 1:
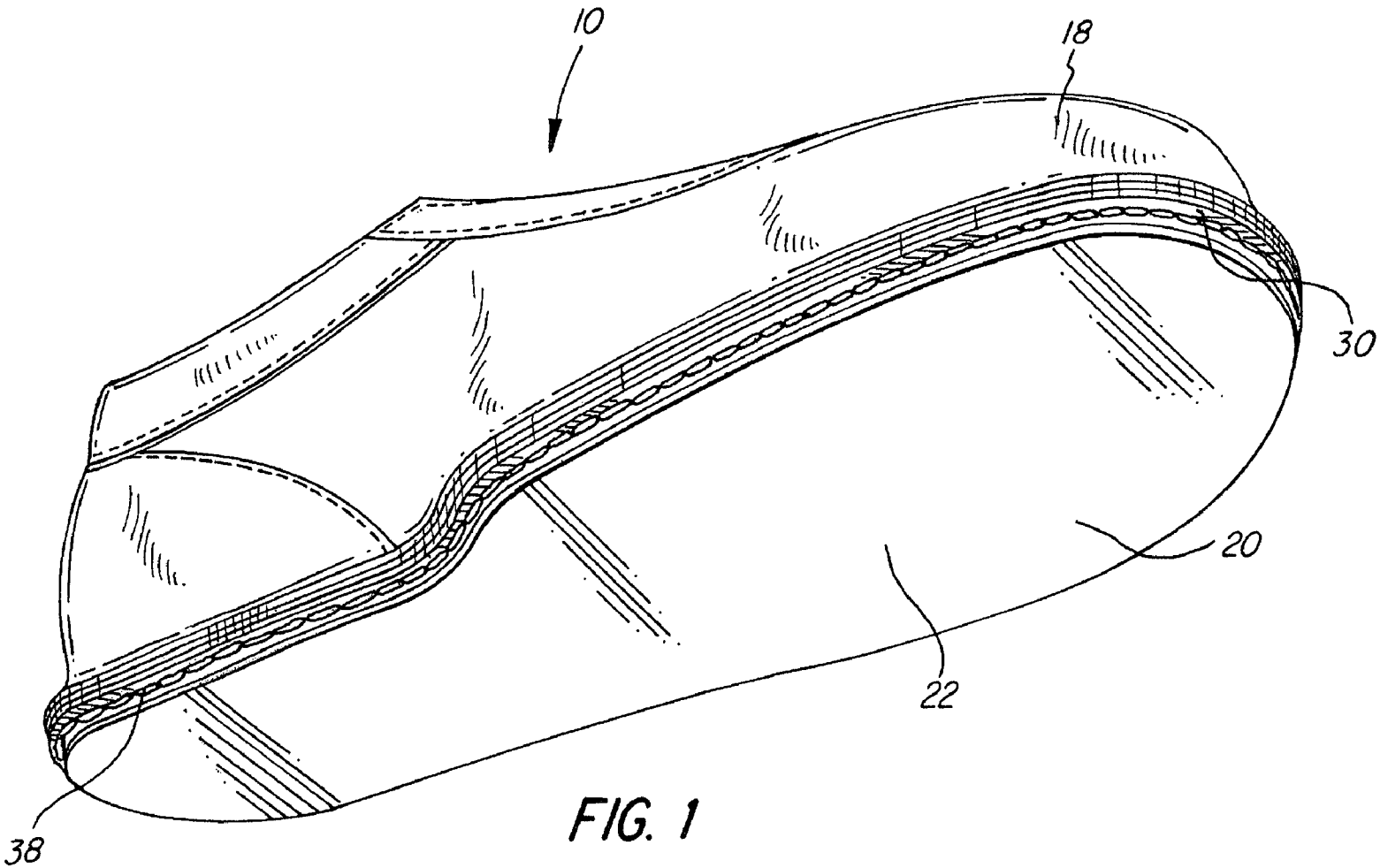
FIG. 1 depicts the shoe in accordance with the invention.

FIG. 1 depicts shoe 10 in accordance with the invention. Shoe 10 includes outsole 20, socklining 40, and securing mechanism 38 for securing socklining 40 to outsole 20. Upper 18 is not germane to the invention but is shown to depict context. Any upper 18 may be used with shoe 10.

Figure 2:
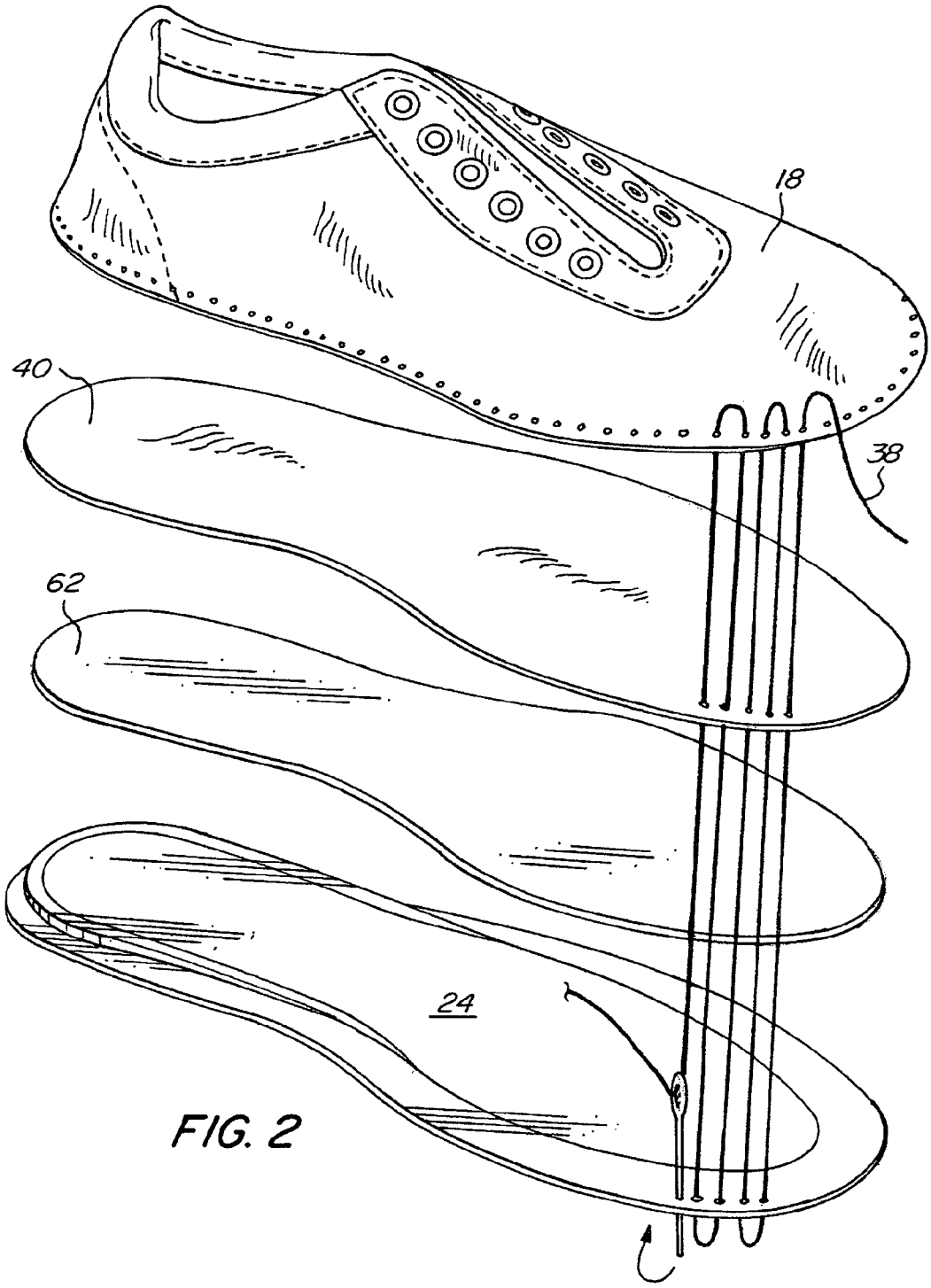
FIG. 2 depicts an assembly view of the components of the shoe shown in FIG. 1.
Figure 3:
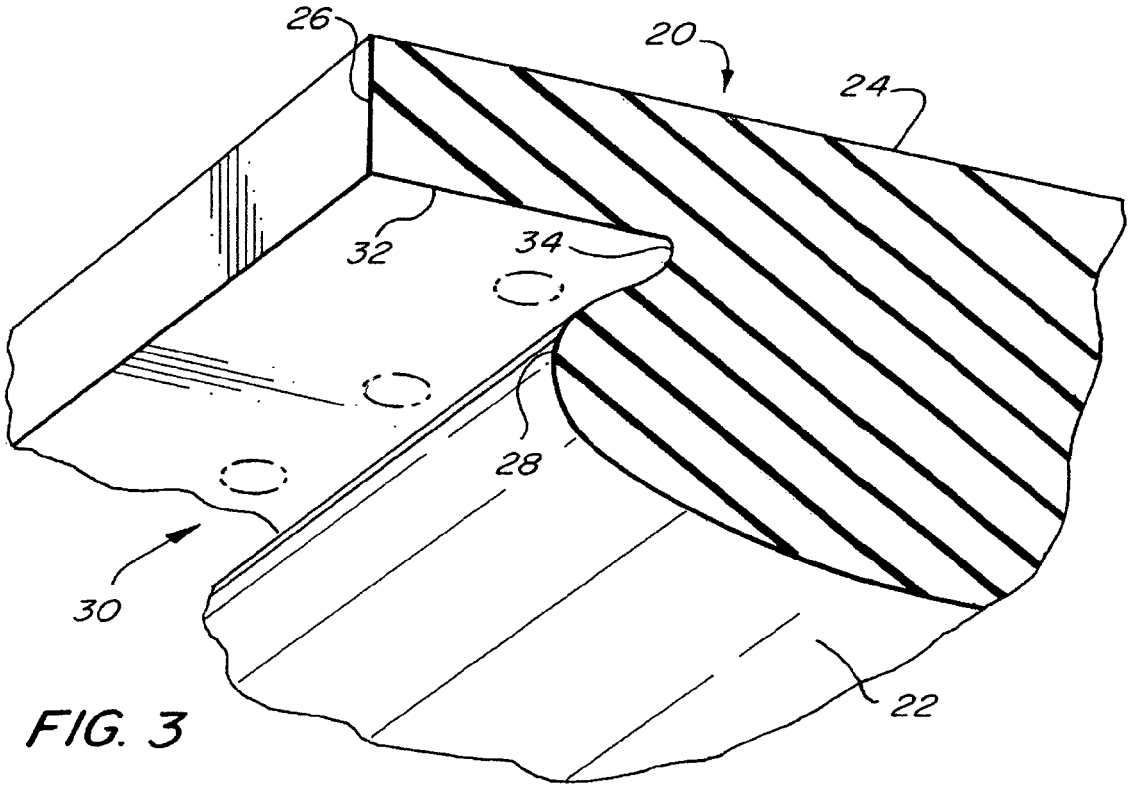
FIG. 3 is a close-up view of the outsole shown in FIG. 1.

As shown more particularly in FIGS. 2 and 3, outsole 20 further includes bottom surface 22 for contacting the ground, top surface 24, and notch 30. Outsole 20 also includes outermost periphery 26 and inner periphery 28, where inner periphery 28 is smaller than outermost periphery 26.

In the embodiment of notch 30 shown, notch 30 includes top surface 32 extending from outermost periphery 26 to inner periphery 28, where top surface 32 is generally perpendicular to and in contact with outermost and inner peripheries 26, 28. Notch 30 also includes vertical wall 34 extending in a generally downward direction in a proximate location to inner periphery 28 for connecting top surface 32 of notch 30 and bottom surface 22 of outsole 20. As shown, top surface 32 of notch 30 is between bottom surface 22 and top surface 24 of outsole 20.

As shown, notch 30 is a step-off in bottom surface 22. However, in further embodiments, notch 30 is any recess, indentation, relief, channel, groove, or etching in bottom surface 22 of outsole 20 sufficient to provide clearance for securing mechanism 38 such that wear upon securing mechanism 38 from contact between bottom surface 22 and the ground is inhibited or reduced. Notch 30 may be formed or manufactured using any known or novel methods or equipment, such as machining, molding, grinding, etching, laser cutting, or the like.

As shown, notch 30 extends upwardly into bottom surface 22 without surrounding securing mechanism 38 on at least one vertical side. In this manner, debris or dirt may have difficulty collecting in notch 30 because notch 30 lacks a vertical or side wall, where more than one vertical or side wall may permit debris to collect between the side walls.

Figure 6A:
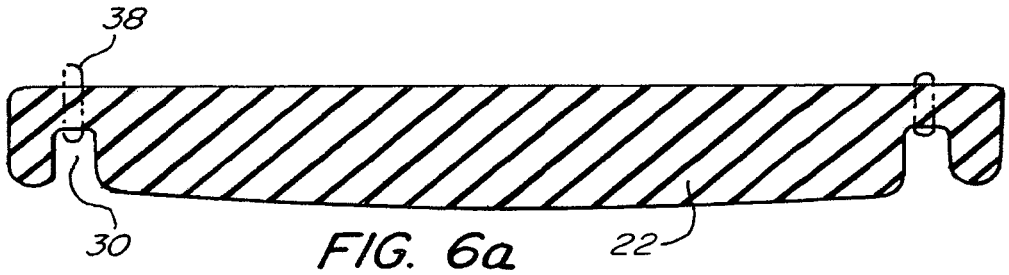
FIG. 6*a* depicts an alternative embodiment of the notch shown in FIG. 1.
Figure 6B:
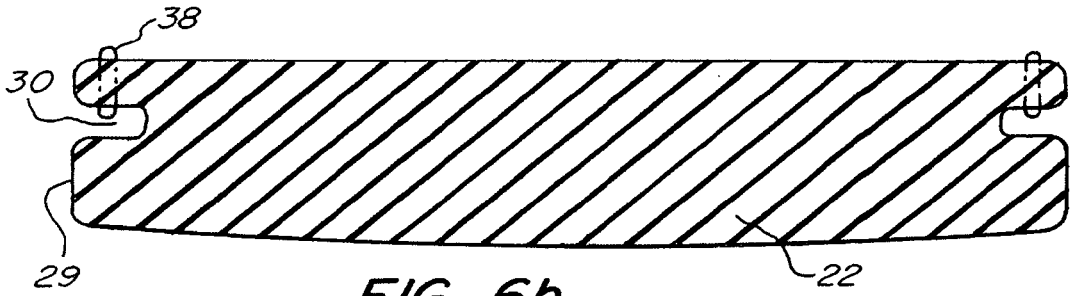
FIG. 6*b* depicts another alternative embodiment of the notch shown in FIG. 1.

As depicted in FIGS. 6*a*–6*b*, notch 30 is shown in alternative embodiments for hindering securing mechanism 38 from premature wear. Notch 30 is a channel in FIG. 6*a*. In FIG. 6*b*, notch 30 is an indentation in a sidewall 29 of outsole 20. This embodiment provides optimum protection to securing mechanism 38 from wear due to bottom surface 22 contacting the ground.

Figure 4:
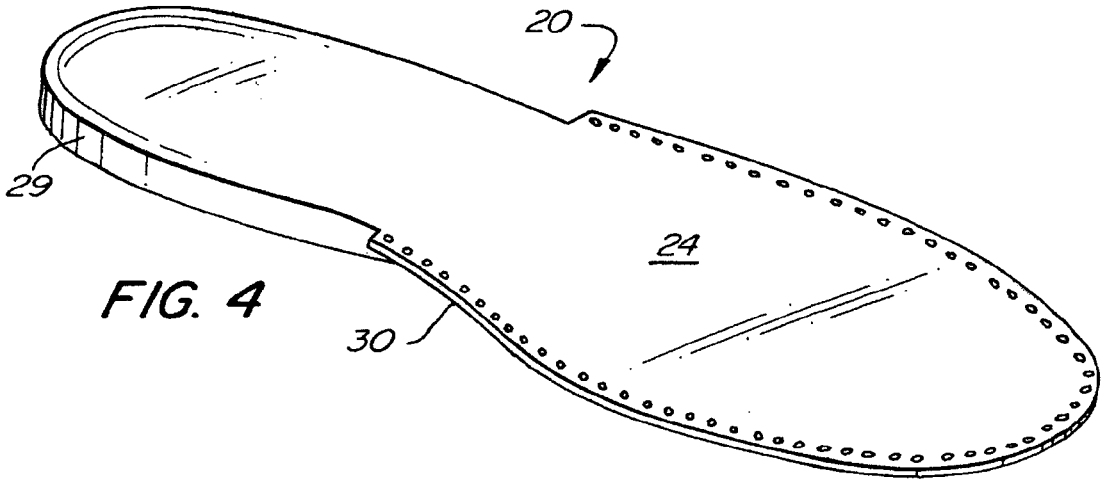
FIG. 4 depicts an alternative embodiment of the outsole shown in FIGS. 1 and 2.

Although notch 30 is shown in FIGS. 1–3 to continuously extend around an entire periphery of outsole 20, it is not necessary for the invention to function properly. FIG. 4 depicts an alternative embodiment of notch 30 that extends around a portion of the entire periphery of outsole 20. All that is required of notch 30 is that it provide clearance for securing mechanism 38 so that wear on securing mechanism 38 due to contact between the ground and bottom surface 22 of outsole 20 is inhibited.

Figure 7:
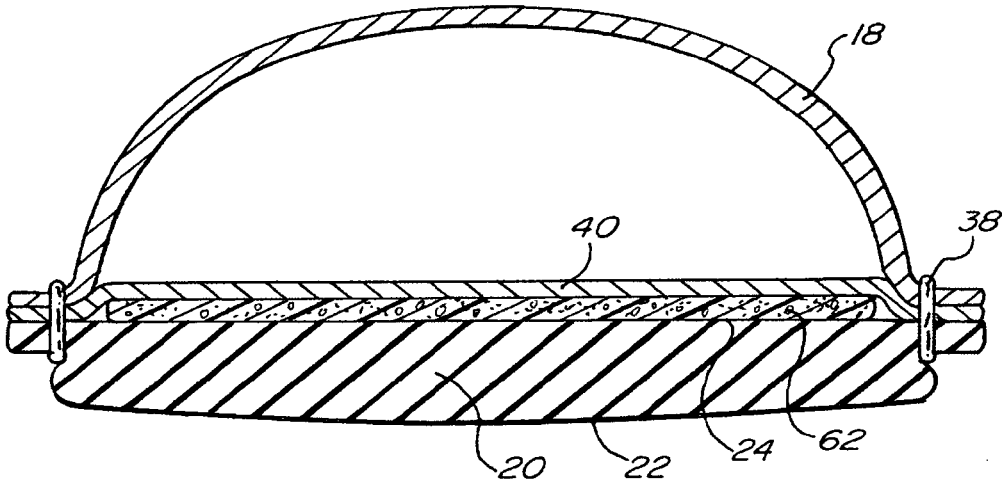
FIG. 7 depicts a cross sectional view of the shoe shown in FIG. 1.

As shown in FIGS. 2 and 7, socklining 40 is in direct contact with top surface 24 of outsole 20. Moreover, socklining 40 is secured to top surface 24 by securing mechanism 38 extending from socklining to notch 30, without extending to bottom surface 22 of outsole 20. In this manner, socklining 40 need not be glued or adhered to top surface 24 of outsole 20, resulting in shoe 10 being made more efficiently. By extending securing mechanism 38 through upper 18, socklining 40, and to notch 30, shoe 10 is completed without a need for an insole, footbed, or tuck. This results in shoe 10 being manufactured more efficiently with less operations.

One advantage shoe 10 provides over traditional shoe constructions is that socklining 40 is secured as upper 18 is secured to outsole 20, obviating later operations for securing socklining 40.

Optionally, cushion 62 may be placed between socklining 40 and top surface 24 of outsole 20 for comforting a user's foot.

Figure 5:
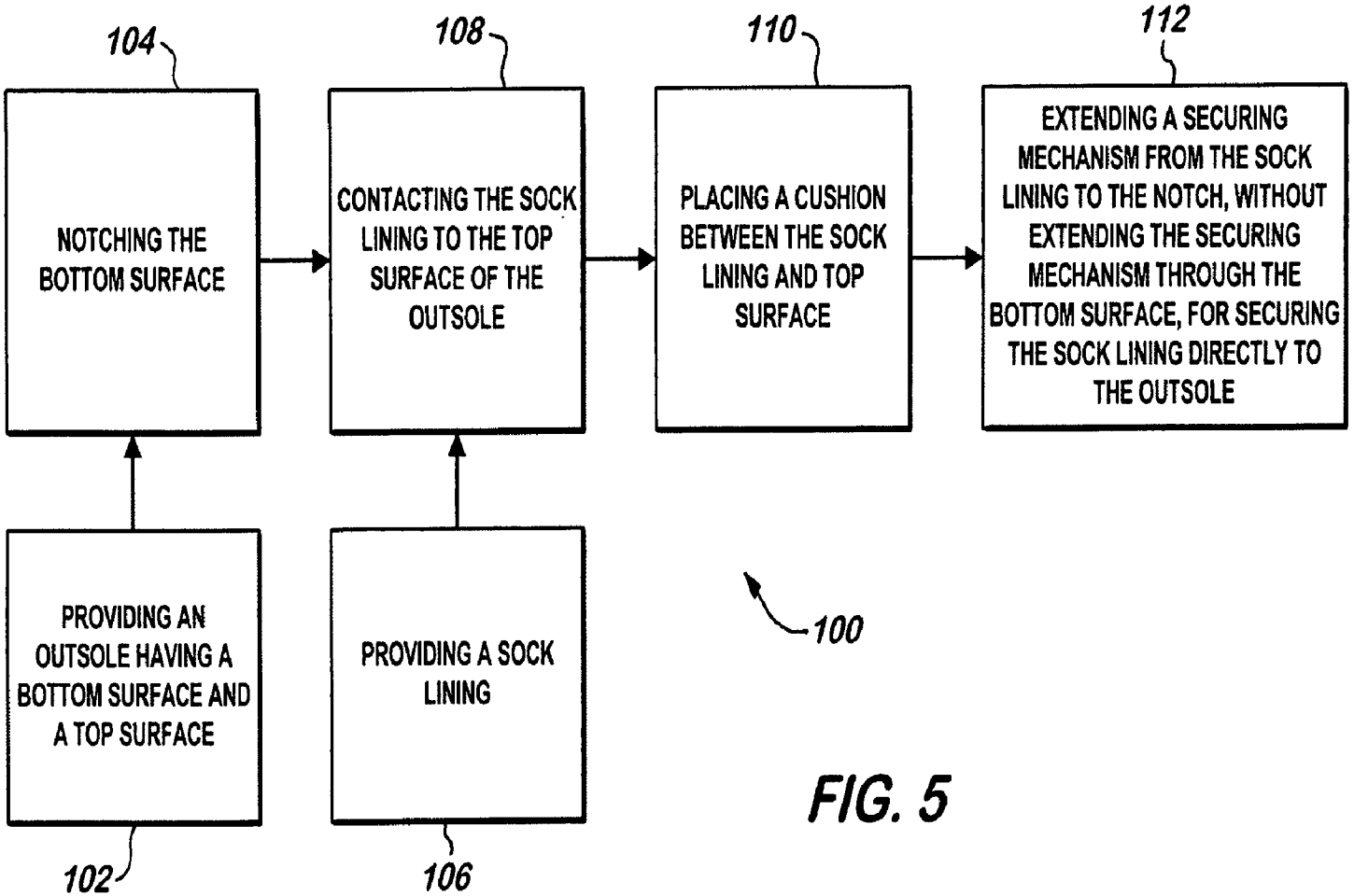
FIG. 5 depicts a method for providing the shoe shown in FIG. 1.

In another aspect of the invention, a method 100 for providing shoe 10 is shown in FIG. 5.

Method 100 includes the step of providing 102 an outsole having a bottom surface for contacting the ground and a top surface. Method 100 also includes notching 104 the bottom surface to provide clearance for a securing mechanism, where the notched bottom surface will hinder the securing mechanism from premature wear due to the bottom surface contacting the ground.

Method 100 further includes the steps of providing 106 a socklining and contacting 108 the socklining to the top surface of the outsole. Optionally, method 100 may include placing 110 a cushion between the socklining and the top surface of the outsole.

To secure the socklining to the outsole, method 100 extends 112 the securing mechanism from the socklining to the notch, without extending the securing mechanism through the bottom surface, for securing the socklining directly to the outsole. The securing mechanism does not extend through the optional cushion, but the cushion is held in place by being sandwiched between the socklining, outsole, and securing mechanism that extends from the socklining to the notch.

In some embodiments, method 100 optionally provides an upper in direct contact with the socklining and extending the securing mechanism from the upper, through the socklining, and to the notch, without extending through the bottom surface, for securing the upper, socklining, and outsole together.

In further embodiments, method 100 includes the step of providing an outermost periphery and an inner periphery smaller than the outermost periphery, extending a top surface of the notch generally perpendicular to and connecting the inner and outermost peripheries together, and extending a vertical wall in a generally downward direction proximate to the inner periphery and connecting the top surface of the notch to the bottom surface of the outsole, wherein the top surface of the notch is between the bottom surface of the outsole and a top surface of the outsole.

In alternative embodiments, instead of notching 104 the bottom surface around an entire periphery of the bottom surface, method 100 notches the bottom surface upwardly into the outsole and around at least one portion of a periphery. Hence, the securing mechanism likewise does not extend around the entire periphery of the shoe but only in the areas of the notches.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A shoe, comprising an outsole having a bottom surface for contacting the ground;

said bottom surface having a notch adapted to receive a stitch and hinder premature wear of the stitch;

a socklining adapted to directly receive a user's foot and having a peripheral edge on top of and in direct contact with said outsole;

a cushion between said outsole and said socklining;

a securing mechanism extending from said socklining to said notch, without extending through said bottom surface, for securing said socklining directly to said out-sole; and said notch includes an outermost periphery of said outsole, an inner periphery smaller than said outermost periphery, a top surface of said notch extending generally perpendicular to and connecting said inner and outermost peripheries together, and a vertical wall extending in a generally downward direction proximate to said inner periphery and connecting said too surface of said notch to said bottom surface of said outsole, wherein said top surface of said notch is between said bottom surface of said outsole and a too surface of said outsole.

2. The shoe according to claim 1, further comprising an upper in direct contact with said socklining.

3. The shoe according to claim 2, said securing mechanism extends from said upper, through said socklining, and to said notch, without extending through said bottom surface, for securing said upper, said socklining, and said outsole together.

4. The shoe according to claim 1, wherein said notch is a relief extending upwardly into said outsole and around at least a portion of a periphery of said outsole.

5. A method for providing a shoe, comprising the steps of:

providing an outsole having a bottom surface for contacting the ground;

notching the bottom surface to provide clearance for a securing mechanism and to hinder the securing mechanism from premature wear due to the bottom surface contacting the ground;

directly contacting a peripheral edge of a socklining to a top surface of the out-sole;

placing a cushion between the outsole and the socklining;

extending the securing mechanism from the socklining to the notch, without extending through the bottom surface, for securing the socklining directly to the outsole; and providing an outermost periphery and an inner periphery smaller than the outermost periphery, extending a top surface of the notch generally perpendicular to and connecting the inner and outermost peripheries together, and extending a vertical wall in a generally downward direction proximate to the inner periphery and connecting the top surface of the notch to the bottom surface of the outsole, wherein the top surface of the notch is between the bottom surface of the outsole and a top surface of the out-sole.

6. The method according to claim 5, further comprising the step of providing an upper in direct contact with the socklining.

7. The method according to claims 6, further comprising the step of extending the securing mechanism from the upper, through the socklining, and to the notch, without extending through the bottom surface, for securing the upper, socklining, and outsole together.

8. The method according to claim 5, further comprising the step of notching the bottom surface upwardly into the outsole and around at least one portion of a periphery of the outsole.

* * * * *